United States Patent [19]

Somogyi

[11] 3,965,665

[45] June 29, 1976

[54] ELECTRONIC WATCH CONSTRUCTION

[75] Inventor: Bela Somogyi, Costa Mesa, Calif.

[73] Assignee: Hughes Aircraft Company, Culver City, Calif.

[22] Filed: Mar. 31, 1975

[21] Appl. No.: 563,926

[52] U.S. Cl. ..... 58/23 BA; 339/256 R
[51] Int. Cl.[2] ..... G04C 3/00; H01R 11/22
[58] Field of Search ..... 58/23 BA, 50 R; 340/309.1, 336; 339/17 R, 256 R

[56] References Cited

UNITED STATES PATENTS

| | | | |
|---|---|---|---|
| 3,680,037 | 7/1972 | Nellis et al. | 339/17 R |
| 3,838,568 | 10/1974 | Zurcher et al. | 58/23 R |
| 3,883,213 | 5/1975 | Glaister | 339/61 M |

FOREIGN PATENTS OR APPLICATIONS

| | | | |
|---|---|---|---|
| 362,653 | 7/1962 | Switzerland | 58/23 BA |

*Primary Examiner*—Edith Simmons Jackmon
*Attorney, Agent, or Firm*—Allen A. Dicke, Jr.; William H. MacAllister

[57] ABSTRACT

Electronic watch is constructed with a ceramic substrate as the principal support of the time computer and memory. The substrate may also carry other devices such as printed circuitry, oscillator and the optical display. Battery connection contacts are positioned on one side of the substrate. A resilient electrically conductive pad is positioned against the contact, and the battery rests against the pad to provide electrical conduction over a large area and to spread shock loads from the battery across a large area of the substrate to both maintain electric contact and minimize mechanical shock.

9 Claims, 1 Drawing Figure

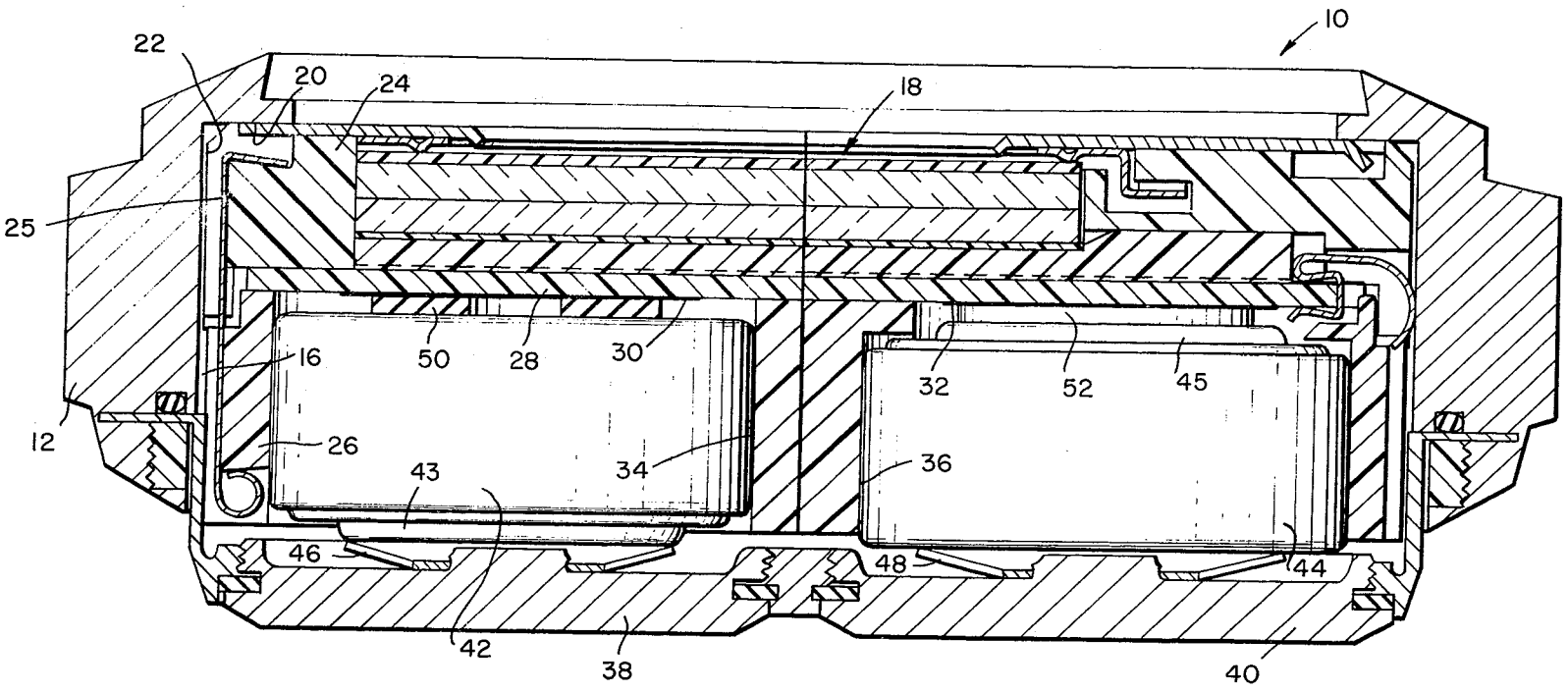
10
18
24
20
22
25
12
16
26
50
28
30
34
43
46
42
38
32
52
45
36
48
44
40

ELECTRONIC WATCH CONSTRUCTION

BACKGROUND OF THE INVENTION

This invention is directed to an electronic watch construction which includes an electrically conductive resilient pad between the battery and the electronic substrate to assure positive electric contact and to spread mechanical shock loading on the substrate.

An electronic watch is a precision electronic device. Electronic devices require an insulator substrate upon which circuits can be printed and structures can be attached. The mounting of an integrated circuit chip on a substrate and its electrical connection to printed circuitry on the substrate require structures of great dimensional stability. Ceramic substrates have the desirable characteristics of receiving printed circuitry, dimensional stability, suitable attachment structure for integrated circuit chips and other mechanical attachments, and are inexpensive and reliable in use.

The electric contacts to which the batteries are connected are usually formed directly on one side of the substrate to minimize the number of interconnections. When the battery rests directly against the substrate and the watch is dropped, the shock force of the battery acting against the substrate causes the substrate to crack, unless special shock mounting for the substrate is provided.

In the past, the substrate has been mounted for both lateral and axial (of the watch, perpendicular to the face) shock motion by resilient shock mounting. This protects the substrate and the rest of the shock mounted structure, but, of course, requires special design to accomplish the shock mounting. Thus, in the past, without special shock mounting, ceramic and other brittle material substrates could be broken within the watch by mechanical shock. The watch construction of this invention increases the amount of permissible mechanical shock applied to the watch without substrate breakage, as compared to a rigidly mounted substrate without this construction.

SUMMARY OF THE INVENTION

In order to aid in the understanding of this invention, it can be stated in essentially summary form that it is directed to an electronic device construction including in combination a substrate carrying electronics, a resilient electrically conductive pad lying against the substrate, and a battery lying against the pad so that electrical continuity is achieved from the battery to the substrate and mechanical shocks from the battery to the substrate are spread over the area of the substrate covered by the pad.

It is thus an object of this invention to provide an electronic device construction which is shock resistant. It is another object to provide an electronic watch construction wherein the mechanical shock of the battery against the electronic substrate is spread over an area of the substrate by the use of a resilient pad. It is another object to provide an electronic device having a resilient pad between the battery connection on the electronics support and the battery in order to provide continuous contact pressure over a substantial contact area to maintain electric contact force during normal operation and to spread shock forces applied from the battery to the support.

Other objects and advantages of this invention will become apparent from the study of the following portions of this specification, the claims and the attached drawings.

BRIEF DESCRIPTION OF THE DRAWINGS

The single FIGURE of the drawings is a section through an electronic watch substantially normal to the watch face and the general plane of the watch showing a section through the battery openings, the adjacent electronic substrate, and showing the resilient electrically conductive pads in place between the batteries and the substrate.

DESCRIPTION OF THE PREFERRED EMBODIMENT

The electronic watch embodying the construction of this invention is generally indicated at 10. Watch 10 has a case 12 which has a frontal opening 14 through which the time indicated by the watch is observed. Case 12 has an open interior 16 in which watch mechanism 18 is located. Case 12 has an inwardly directed shoulder 20 for axially locating watch mechanism 18 with respect to the case. Case wall 22 provides radial location for the watch mechanism 18.

Structurally major parts of the watch mechanism 18 are front spacer 24, rear spacer 26, and substrate 28. Substrate 28 carries a principal part of the electronics of the electronic watch of this invention. It may have one or more miniaturized electronic integrated circuit chips secured thereto, usually the front thereof which is the top of the substrate, as seen in the drawing. Printed circuits are positioned thereon for connection to the chip, to the watch control switches, and to the display. Electric contacts 30 and 32 are positioned on the rear of substrate 28 and are connected by vias therethrough to the circuitry on the front. If desired, some of the circuitry and interconnections can be on the rear of the substrate.

Front spacer 24 engages within case wall 22 and against shoulder 20. Substrate 28 engages in the front spacer. Rear spacer 26 engages the front spacer and holds substrate 28 in place. Any convenient means such as springs 25 can be used to clamp the front and rear spacers 24 and 26 together. For more details of the construction of the particular watch, reference is made to Ser. Number, 563,927 filed Mar. 31, 1975 for "Electronic Watch Construction," by Roger A. Burke, Rudolf F. Zurcher, and Bela Somogyi, the entire disclosure of which is incorporated herein by this reference.

Battery openings 34 and 36 are formed in rear spacer 26. Battery hatches 38 and 40 are respectively formed over the battery openings. Batteries 42 and 44 are respectively located in battery openings 34 and 36. Batteries 42 and 44 each have a case at one battery potential and a contact button at the other battery potential. The contact button is insulated from the case. Contact buttons 43 and 45 are respectively shown on batteries 42 and 44. The contact buttons are metallic and usually are not perfectly flat, due to manufacturing tolerances. In accordance with the usual battery construction, the case diameter is larger than the contact button diameter. Metallic springs 46 and 48 urge the batteries upward toward the ceramic substrate. Resilient electrical conductor pads 50 and 52 are respectively positioned between the batteries 42 and 44 and their contacts 30 and 32. Each of the pads is a flat, circular disc with a central hole. The diameter of each of the pads 50 and 52 is substantially equal to the diameter of the battery contact buttons. The material of each pad is silicone rubber impregnated with silver powder so that there is almost no electrical resistance. In the processing of the rubber, silver powder is loaded in during the milling to a sufficient degree that, in the end product, the resistance is below that measurable with the usual commercial resistance meter. A composition made by Cal-metex Corp. is suitable. Calmetex Corp. is located at 509 Hindry Ave., Inglewood, California 90301. The material used is style XCS-14.

With the watch assembled, the battery hatch cover stresses the spring and urges the battery upward against the conductor pad, which engages against its contact. The upward force of substrate 28 is an upward force against front spacer 24, which engages against shoulder 20 of the case to balance the load. The force of the battery against the substrate is spread over the large area of the conductor pad, rather than concentrated, so that the battery force is over the pad area, substantially the diameter of the battery contact buttons. Now, when the watch is dropped face down, the battery shock force due to the momentum at the end of the drop is transmitted onto a large area of substrate 28 through the agency of the large area of the conductor pad. This load spreading prevents stress concentration, which would cause cracking of the ceramic substrate. With the load spreading, the ceramic substrate is capable of receiving normal shocks, such as dropping the watch, without cracking.

As thus shown, the resiliency of the resilient electrical conductor pads spreads the load, makes electrical contact, and takes up shock. In those cases where the resiliency of the pad is sufficient, it can also be employed to maintain the battery contact pressure. There is a dimensional tolerance buildup of parts through the case from shoulder 20 to the inside of the battery hatch, and there is a dimensional tolerance buildup of parts through the watch mechanism 18 from shoulder 20 to the back of battery 42. If conductor pad 50 is of sufficient resiliency to be able to accommodate for the buildup of tolerances of these parts so that there is always sufficient battery contact pressure, then battery spring 46 can be eliminated. In that case, the battery contact pad 50 performs the third function of maintaining contact pressure on both sides of the battery, as well as providing an electrical conductor and spreading the mechanical loads.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

I claim:

1. In combination in an electronic watch:

a support for carrying components of said electronic watch and an electric contact for connection of battery voltage for at least in part powering said electronic watch;

a nonmetallic resilient electrically conductive pad positioned against said electric contact on said support;

a battery having a contact and having its contact positioned against said resilient electrically conductive pad; and means engaging said battery and said support for physically restraining said battery and support so that said resilient electrically conductive pad is maintained in a stressed, resiliently deflected position to maintain an area of electric contact on said battery contact and said electric contact on said support substantially as large as a battery contact to spread both electric contact area and mechanical force from said battery onto said support.

2. The combination of claim 1 wherein said resilient electrically conductive pad is a metal containing elastomeric pad.

3. The combination of claim 2 wherein said pad is a silicone rubber pad having silver powder therein.

4. In combination in an electronic device:

a support for supporting components of said electronic device including an electrical conductor on said support for electrical connection to a battery for at least in part powering the electronic equipment of said electronic device;

a battery having a contact for supplying electric current to said electronic equipment;

means for mechanically engaging both said battery and said support to physically restrain said battery and said support from separating forces; and means comprising a resilient pad for spreading the force of said battery over an area of said support substantially as large as the battery contact and for electrically connecting the battery contact to said electronic equipment for spreading physical shock loadings from said battery onto said support and for making electrical contact between said battery and said electrical conductor on said support.

5. The combination of claim 4 wherein said pad is a perforated disc.

6. The combination of claim 4 wherein said pad is made of an electrically conductive powder loaded elastomer.

7. The combination of claim 6 wherein said pad is made out of silver powder loaded silicone rubber.

8. In combination in an electronic device:

a support for supporting components of said electronic device including an electrical conductor on said support for electrical connection to a battery for at least in part powering the electronic equipment of said electronic device;

a battery having a contact for supplying electric current to said electronic equipment;

means for mechanically engaging both said battery and said support to physically restrain said battery and said support from separating forces;

means comprising an elastomeric member positioned between said battery and one side of said support for spreading the force of said battery over an area of said support substantially as large as said elastomeric member, and for conducting electric current from said battery on one side of said member to said electronic equipment on said support on the other side of said member.

9. The combination of claim 8 wherein said member comprises a resilient electrically conductive pad for resiliently deflecting and maintaining contact pressure resulting from said means for engaging.

* * * * *